US006070354A

United States Patent [19]

Burigana et al.

[11] Patent Number: 6,070,354

[45] Date of Patent: Jun. 6, 2000

[54] FIREARM WITH METAL INSERT IN MONOLITHIC HOUSING AND STOCK

[75] Inventors: Lucio Burigana, Roveredo in Piano; Marco Vignaroli, Perugia; Rolando Caldari, Urbino; Sergio Scaramucci, Gallo di Petriano, all of Italy

[73] Assignee: Benelli Armi S.p.A., Italy

[21] Appl. No.: 09/153,005

[22] Filed: Sep. 14, 1998

[30] Foreign Application Priority Data

Sep. 17, 1997 [IT] Italy ..... MI97A2105

[51] Int. Cl.[7] ..... F41C 23/18

[52] U.S. Cl. ..... 42/71.01

[58] Field of Search ..... 42/71.01, 72, 75.02, 42/85

[56] References Cited

U.S. PATENT DOCUMENTS

| | | | |
|---|---|---|---|
| D. 160,151 | 1/1950 | Duncan | 42/71.01 |
| D. 219,738 | 1/1971 | Frix | 42/71.01 |
| D. 219,969 | 2/1971 | Selnau | 42/71.01 |
| 662,068 | 11/1900 | Hamilton | 42/71.01 |
| 816,074 | 3/1906 | Cole | 42/71.01 |
| 1,206,234 | 11/1916 | Lovell | 42/71.01 |
| 1,309,605 | 7/1919 | Badger | 42/85 |
| 2,292,351 | 8/1942 | Carpenter et al. | 42/71.01 |
| 2,439,137 | 4/1948 | Keller | 42/71.01 |
| 2,642,689 | 6/1953 | Cline | 42/85 |
| 2,753,642 | 7/1956 | Sullivan | 42/71.01 |
| 3,011,283 | 12/1961 | Lunn et al. | 42/71.01 |
| 3,242,608 | 3/1966 | Heppard | 42/71.01 |
| 4,513,523 | 4/1985 | Gal | 42/72 |
| 4,571,872 | 2/1986 | Johnson | 42/85 |
| 4,654,993 | 4/1987 | Atchisson | 42/71.01 |
| 4,674,216 | 6/1987 | Ruger et al. | 42/71.01 |
| 5,179,245 | 1/1993 | Straka | 89/1.42 |
| 5,513,461 | 5/1996 | Weldle | 42/71.01 |
| 5,615,508 | 4/1997 | Miller et al. | 42/71.01 |
| 5,711,102 | 1/1998 | Plaster et al. | 42/71.01 |
| 5,864,978 | 2/1999 | McRary et al. | 42/71.01 |

FOREIGN PATENT DOCUMENTS 0 428 292 A2 5/1991 European Pat. Off. .

*Primary Examiner*—Charles T. Jordan
*Assistant Examiner*—Denise J Buckley
*Attorney, Agent, or Firm*—R. Neil Sudol; Henry D. Coleman

[57] ABSTRACT

A portable weapon having a monolithic housing and stock made of plastics and provided with a metal insert for strengthening the structure.

18 Claims, 8 Drawing Sheets

FIREARM WITH METAL INSERT IN MONOLITHIC HOUSING AND STOCK

BACKGROUND OF THE INVENTION

1. Field of the Invention

The present invention relates to a portable weapon.

More particularly, the invention relates to a portable weapon such as a smoothbore rifle, or shotgun.

2. Description of the Prior Art

Shotguns generally include a supporting structure constituting the frame or housing, made of steel or light alloy, for example Ergal.

The materials used to manufacture the frame in conventional weapons provide excellent performance from the technical point of view, but also have the drawback of high cost. Furthermore, a frame manufactured according to conventional methods has a high production cost caused by the relatively large number of machining operations required to obtain it.

Conventional weapons, such as the shotguns, also have a stock, generally made of wood or possibly plastics or metal, for example of the folding type.

The drawback of this conventional structure is, in this case also, due to the need to assemble the various parts that constitute the stock and to assemble the stock to the weapon.

DE-19512178 discloses a shotgun having a plastic housing provided with a metal insert.

U.S. Pat. No. 5,513,461 discloses a lightweight automatic rifle having a hollow plastic housing provided with a metal sleeve.

U.S. Pat. No. 4,674,216 discloses a plastic rifle stock with panel inserts.

FR-814.999 discloses a fiber based stock for a portable weapon.

The above mentioned prior art weapons require a number of production steps to manufacture the stock and housing.

The aim of the present invention is to provide a portable weapon, particularly a smoothbore rifle or shotgun, which solves the above mentioned problems of the prior art.

A further object of the invention is to provide a shotgun that is cheap from the point of view of production.

A further object of the invention is to provide a shotgun that can be obtained with a substantially reduced number of manufacturing steps compared with conventional methods for manufacturing weapons.

SUMMARY OF THE INVENTION

The above aims, and other aims that will become apparent to those skilled in the art, are achieved by a portable weapon, as claimed in the appended claims.

Further characteristics and advantages of the invention will become apparent from a reading of the detailed description of a preferred but not exclusive embodiment of a portable weapon, according to the invention, illustrated only by way of a non-limiting example in the accompanying drawings.

DESCRIPTION OF THE PREFERRED EMBODIMENTS OF THE INVENTION

Figure 9:
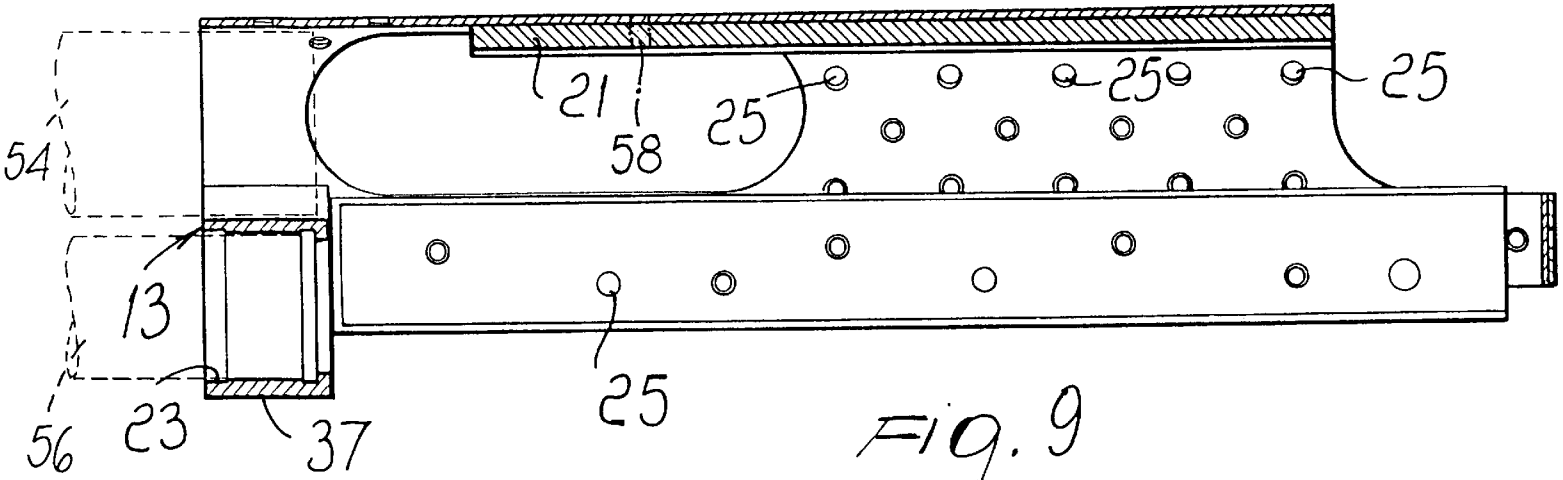
FIG. 9 is a sectional view, taken along the plane IX—IX of FIG. 7.

With reference to the above figures, the portable weapon according to the invention, generally designated by the reference numeral 1 is a shotgun constituted, in its essential parts, by a frame or housing 3, a stock 5, a barrel 54 (FIG. 9) and a tubular magazine 56.

Housing 3 and stock 5 are formed monolithically and the stock 5 is hollow in order to accommodate optional accessories, which can be fixed to an internal supporting means, such as for example the holes 45.

Stock 5 is associated with housing 3 by means of a grip region 7, which is advantageously provided with a grip means constituted by radial raised portions 9 surrounding grip 7 in order to facilitate the user in holding the weapon.

Housing 3 is at least partially hollow so as to accommodate the various firing devices of the weapon, in a per se known manner.

In particular, housing 3 is open at the front in order to accommodate the barrel (not shown in the figures) and in a lower region in order to accommodate the breech-lock and the firing mechanism (not shown).

According to the invention, the weapon housing is manufactured by molding and is entirely made of plastics, for example polyamide, and the stock is monolithic with the housing.

A metal insert 11 is provided in the housing, in order to improve the technical properties of the housing, in particular its strength and durability. The metal insert is adapted to provide greater strength in selected regions of the housing which are subjected to particular stresses.

Insert 11 is constituted by a boxlike body having a transverse cross-section substantially shaped like an inverted U and corresponding to the cross-section of the housing.

Figure 11:
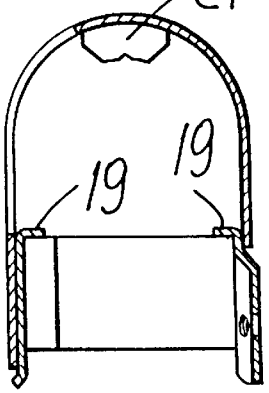
FIG. 11 is a sectional view, taken along the plane XI—XI of FIG. 8.
Figure 12:
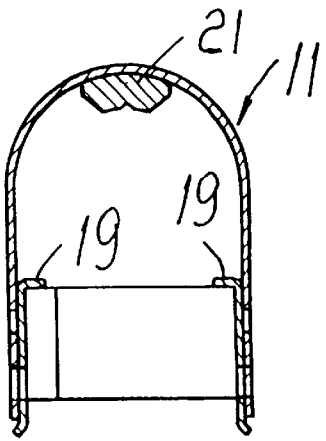
FIG. 12 is a sectional view, taken along the plane XII—XII of FIG. 8.
Figure 10:
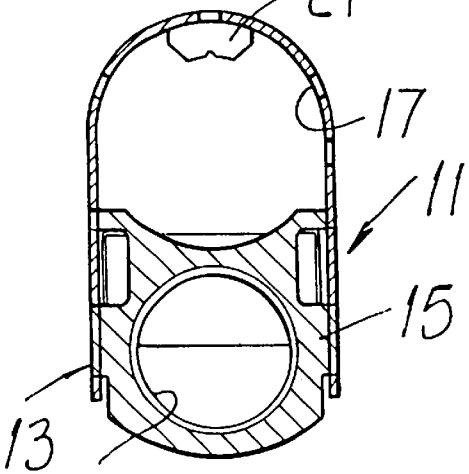
FIG. 10 is a sectional view, taken along the plane X—X of FIG. 8.
Figure 13:
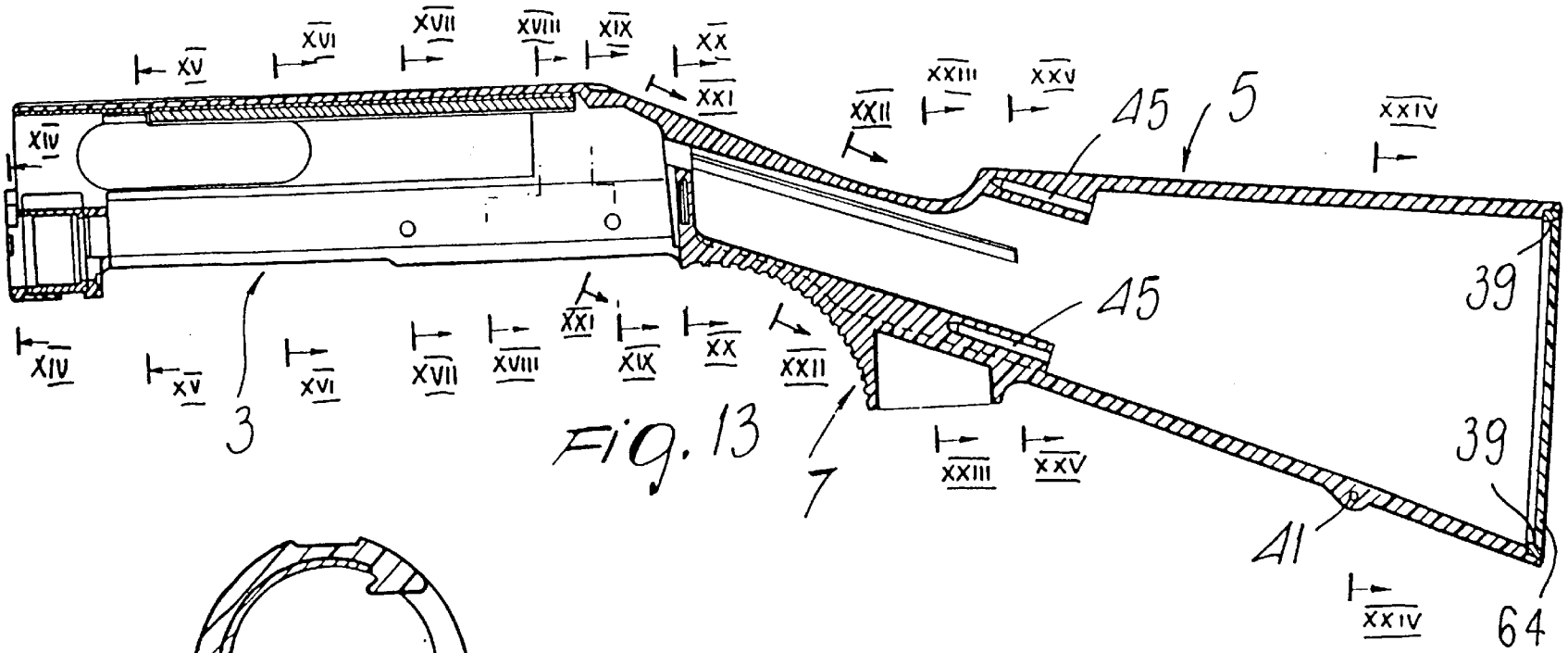
FIG. 13 is a sectional lateral elevation view, taken along a longitudinal plane, of the housing according to the invention.

Insert 11 includes a front portion 13, constituted by a plate 15 provided with a threaded coupling 23, for the tubular magazine (not shown), and by a radiused coupling 17 for accommodating the barrel (not shown) of the weapon. As shown more clearly in FIGS. 11 and 12, longitudinal guides 19 are provided inside insert 11 for the breech-lock (not shown) of the weapon.

Insert 11 also includes a longitudinal member 21 which is associated, for example by welding, in an upward region inside the insert; its function is to guide the rotating head (not shown) of the breech-lock. Bores or perforation 58 can be provided in longitudinal member 21 so as to constitute a support for optional accessories which can be applied to the housing, for example an aiming device.

Since insert 11 is embedded in housing 3 during molding, it advantageously has holes 25 which are suitable to be filled by the plastic material during the molding operation.

Figure 1:
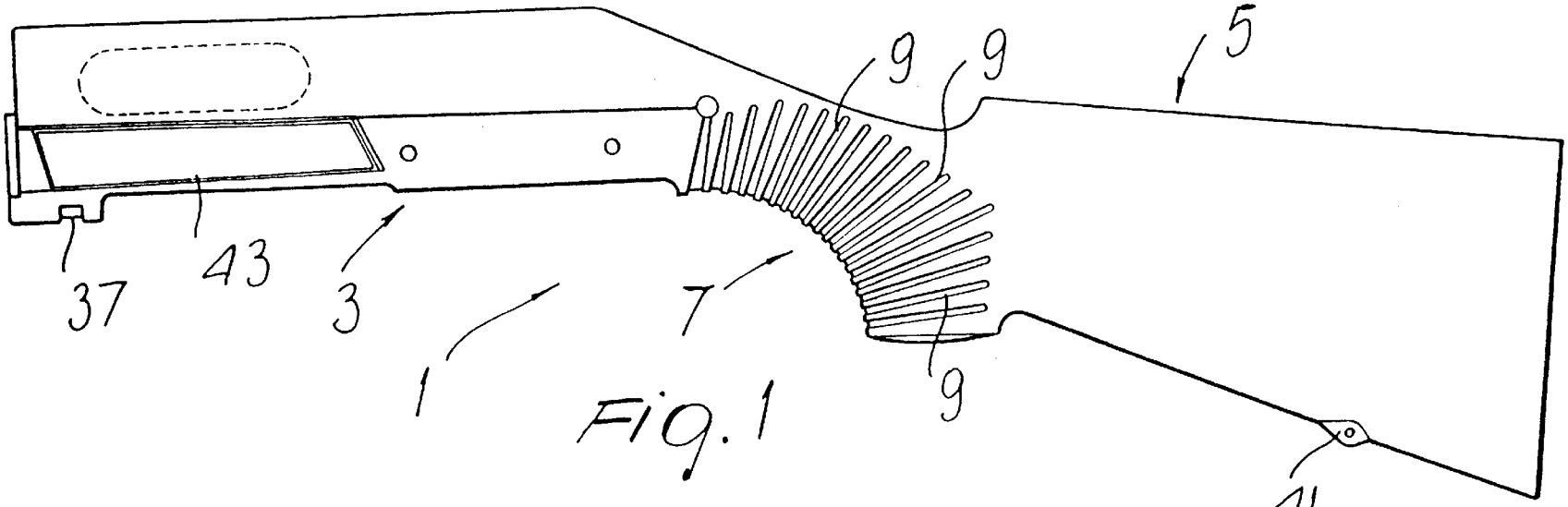
FIG. 1 is a side view of the portable weapon according to the present invention.
Figure 2:
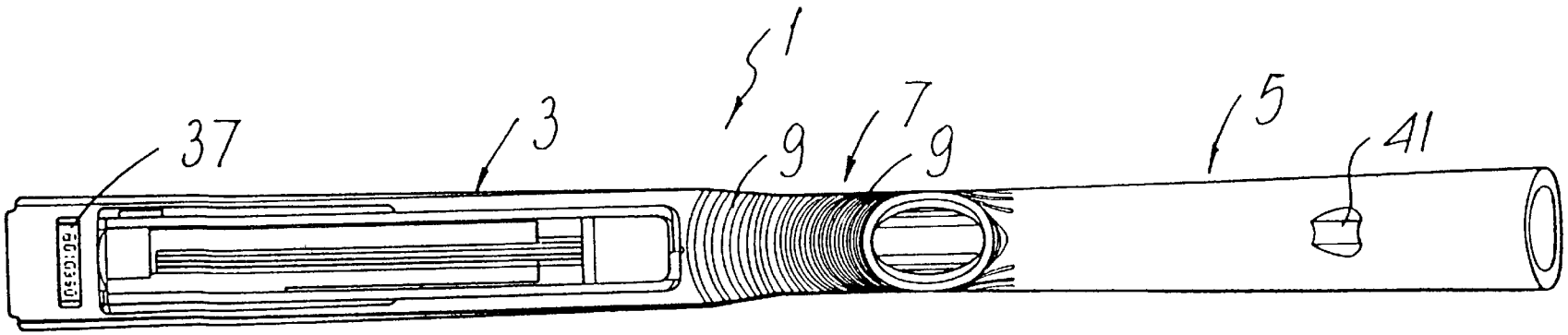
FIG. 2 is a bottom view of the weapon of FIG. 1.
Figure 3:
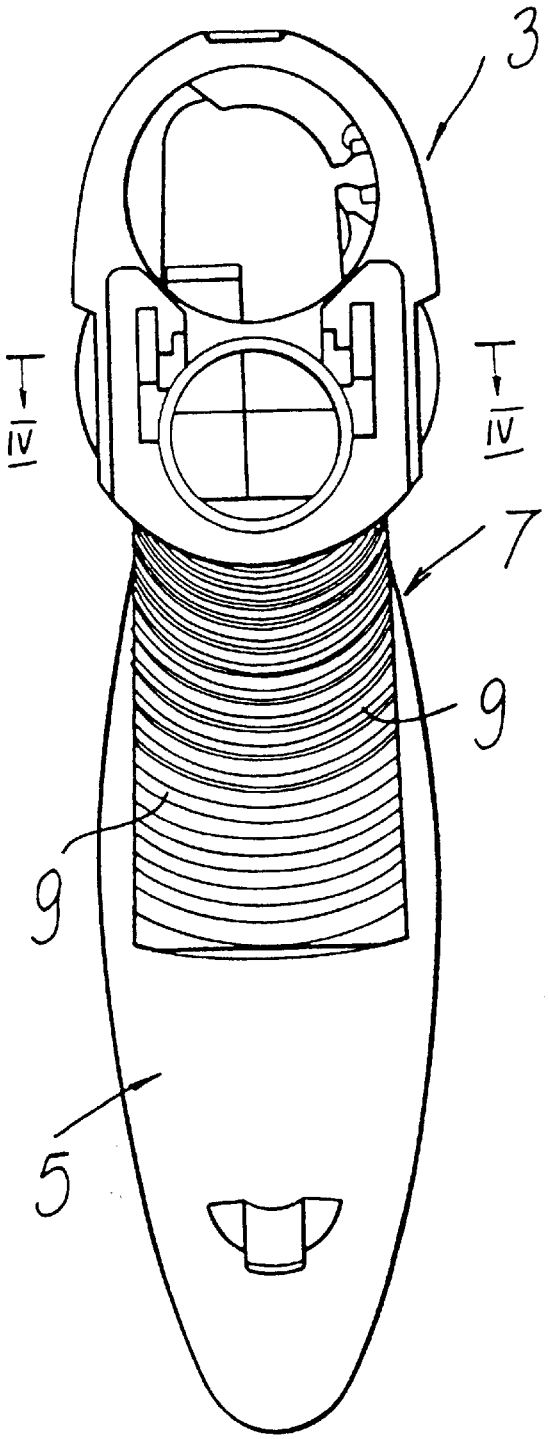
FIG. 3 is a front view of the weapon.
Figure 4:
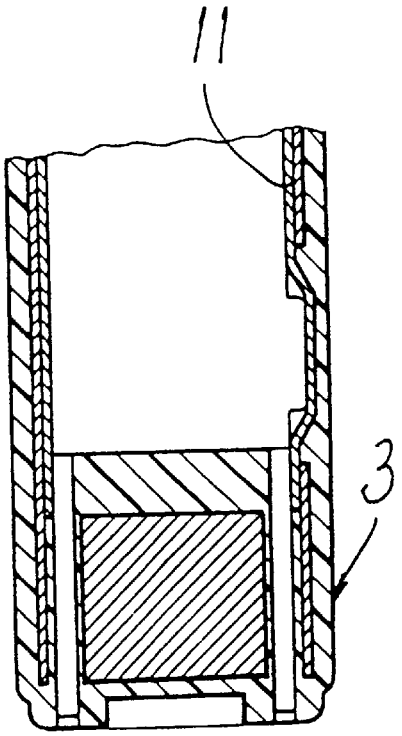
FIG. 4 is a partial sectional view, taken along the plane IV—IV of FIG. 3.
Figure 6:
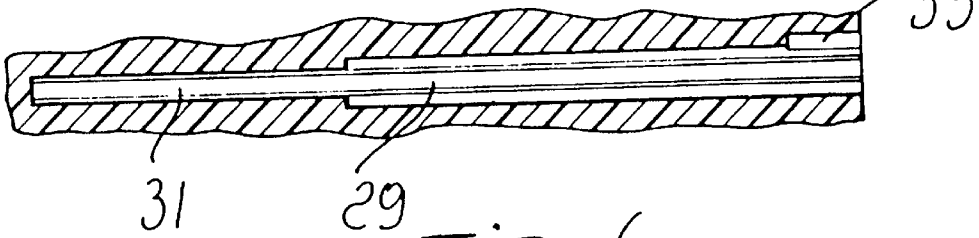
FIG. 6 is a partial sectional enlarged-scale view, taken along a longitudinal plane, of the seat of the ejector.
Figure 5:
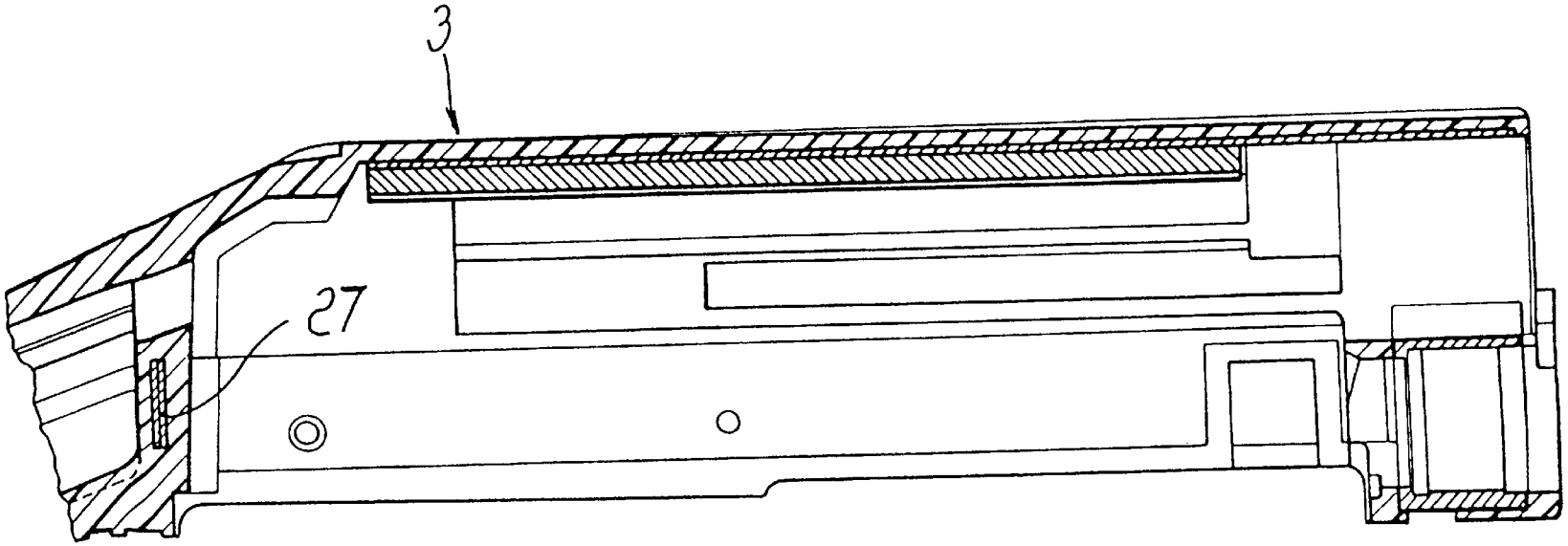
FIG. 5 is a partial and partially sectional enlarged-scale side view of the housing.
Figure 8:
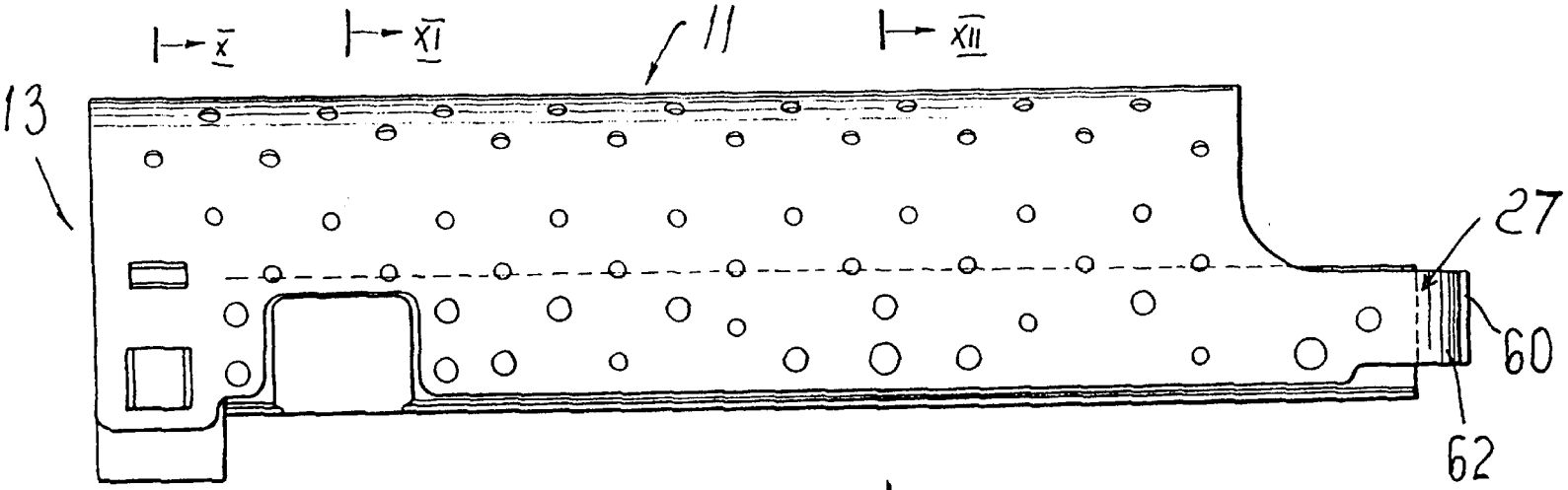
FIG. 8 is a side view of the insert.
Figure 7:
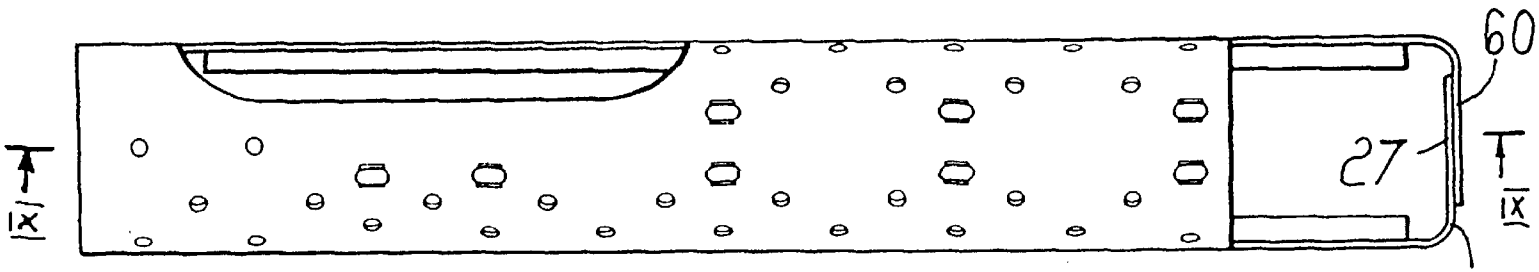
FIG. 7 is a plan view of the insert according to the invention.

Insert 11 also includes a rear shoulder 27 which is constituted by two folded flaps 60 and 62 and is suitable to be embedded in the plastic material, as shown more clearly in FIG. 5.

FIGS. 4 and 13–21 show in greater detail how insert 11 is embedded in the plastic material that constitutes housing 3. Housing 3 includes an ejector seat 29 which is blended with a seat 31 for the ejector spring (not shown), which is of the movable type in order to adapt to cartridges of different lengths, in a per se known manner. Elector seat 29 also includes a seat 33 for a retaining pin (not shown) adapted to keen the ejector in its seat when the barrel is disassembled.

Figure 14:
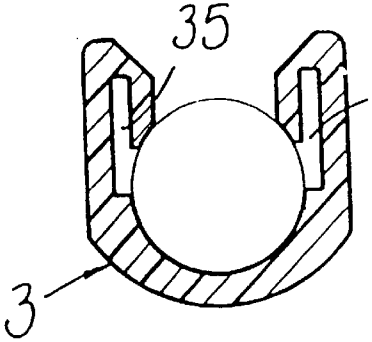
FIG. 14 is a sectional view, taken along the plane XIV—XIV of FIG. 13.
Figure 15:
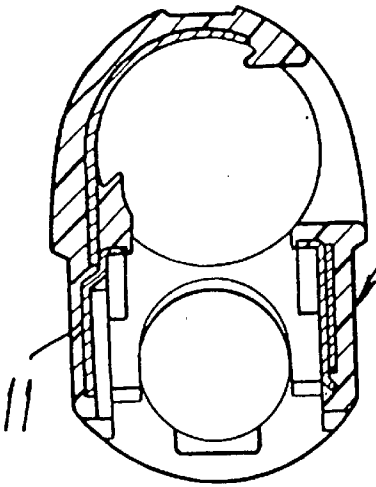
FIG. 15 is a sectional view, taken along the plane XV—XV of FIG. 13.
Figure 16:
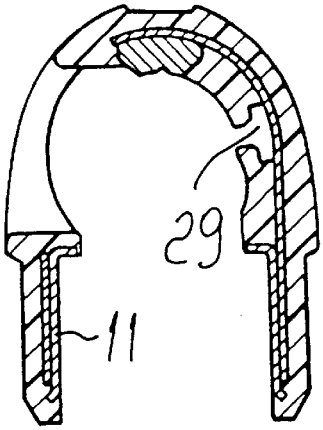
FIG. 16 is a sectional view, taken along the plane XVI—XVI of FIG. 13.
Figure 17:
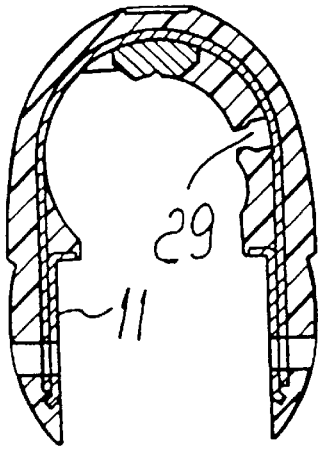
FIG. 17 is a sectional view, taken along the plane XVII—XVII of FIG. 13.
Figure 18:
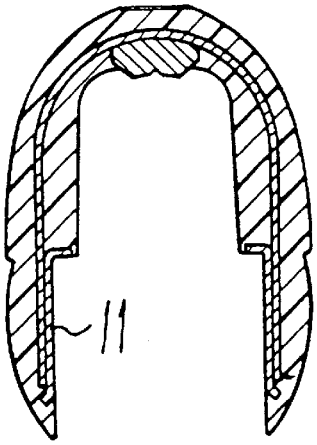
FIG. 18 is a sectional view, taken along the plane XVIII—XVIII of FIG. 13.
Figure 19:
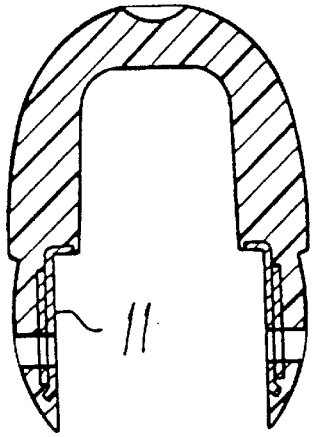
FIG. 19 is a sectional view, taken along the plane XIX—XIX of FIG. 13.
Figure 20:
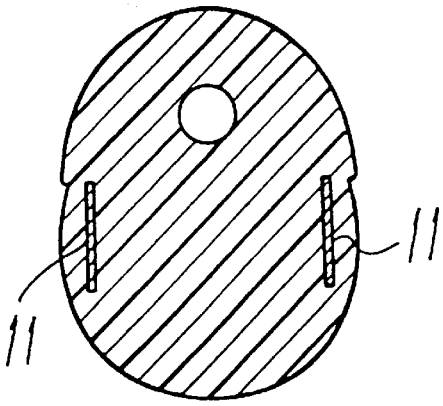
FIG. 20 is a sectional view, taken along the plane XXI—XXI of FIG. 13.
Figure 21:
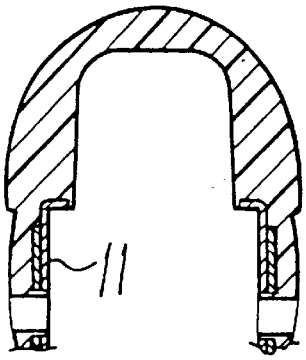
FIG. 21 is a sectional view, taken along the plane XXII—XXII of FIG. 13.
Figure 22:
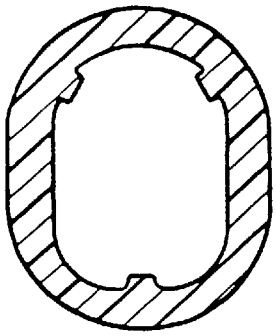
FIG. 22 is a sectional view, taken along the plane XXII—XXII of FIG. 13.
Figure 23:
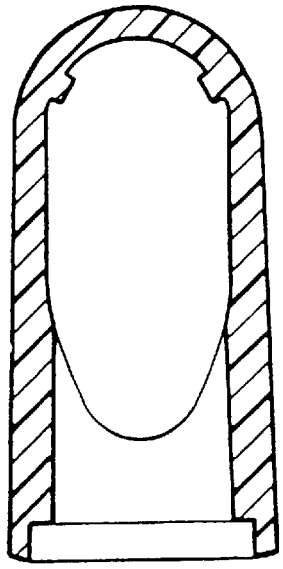
FIG. 23 is a sectional view, taken along the plane XXIII—XXIII of FIG. 13.
Figure 24:
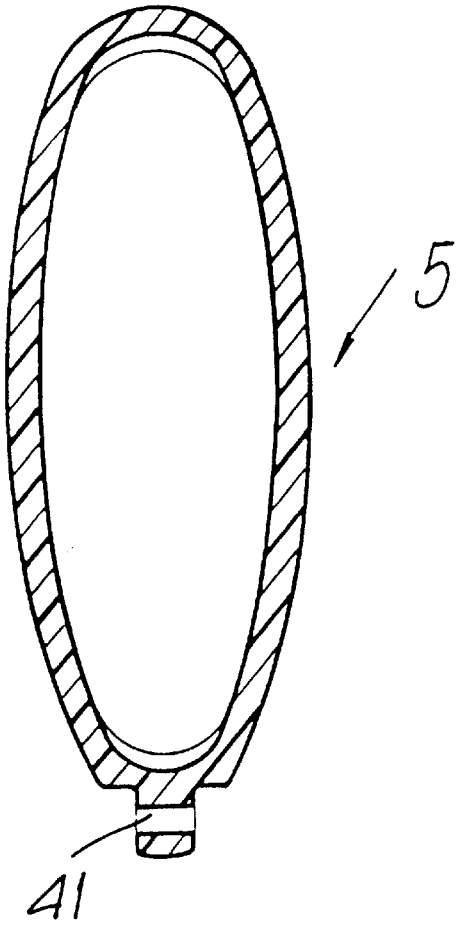
FIG. 24 is a sectional view, taken along the plane XXIV—XXIV of FIG. 13.
Figure 25:
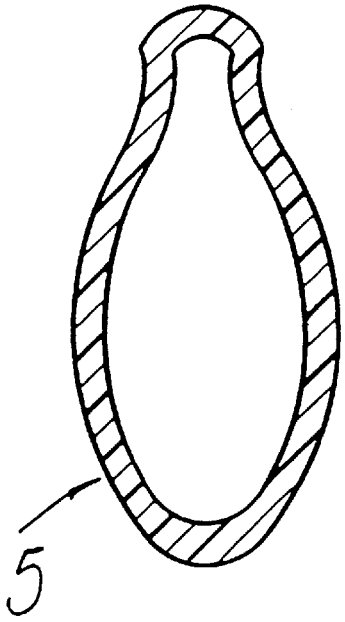
FIG. 25 is a sectional view, taken along the plane XXV—XXV of FIG. 13.

FIG. 14 is a section view of guiding seats 35 adapted to ease the insertion of the braces (not shown) of the breech during weapon assembly.

A lower portion 37 of insert 11 is arranged outside the plastic housing in order to allow to permanently imprint the serial number, or other form of identification of the weapon, prescribed by statutory provisions.

An engagement means 39 is provided in a lower region of stock 5. Engagement means 39 is provided for the connection of a base-plate 64 without using screws or the like, and a slot 41 for fastening the strap or brace (not shown). Slot 41 is advantageously formed monolithically with the stock and therefore without using screws or other external fastening devices.

One side of the housing 3 is provided with a seat 43 for optionally accommodating removable members which contain ornamental patterns or labels.

In practice it has been observed that the weapon according to the invention achieves the intended aim and objects, a portable weapon having been provided wherein the housing can be obtained by molding with a single operation.

One advantage of the invention is the fact that the material used is cheap with respect to the materials used conventionally, despite maintaining excellent technical properties.

The metal insert allows to improve the mechanical strength of the structure and to extend its durability.

Another advantage is the possibility to form the stock monolithically with the housing, reducing the number of operations of the production process.

Another advantage is the possibility to form complex ornamental patterns on the weapon which cannot be provided in conventional rifles or in any case can be provided at a much higher cost.

The portable weapon according to the invention is susceptible of numerous modifications and variations, all of which are within the scope of the inventive concept; all the details may furthermore be replaced with technically equivalent parts.

The materials used, as well as the dimensions, may of course be any according to the requirements and the state of the art.

What is claimed is:

1. A firearm comprising a barrel, a breech assembly, a magazine and a monolithic housing and stock made of plastic material and provided with a metal insert including a plate, said insert including a front portion having a threaded coupling for connection of said magazine and a radiused coupling for connection of said barrel.

2. The firearm according to claim 1, wherein said housing has a transverse first cross-section and said metal insert has a transverse second cross-section substantially shaped like an inverted U and matching said first cross-section.

3. The firearm according to claim 2, wherein said insert is provided with a longitudinal member which is disposed inside said insert in an upper region thereof for guiding a breech member.

4. The firearm according to claim 3, wherein said longitudinal member is perforated to provide a support for optional accessories mounted to said housing.

5. The firearm according to claim 1, wherein said insert includes a rear shoulder formed by two folded flaps embedded in said plastic material.

6. The firearm according to claim 1, wherein said insert has a lower portion which is arranged outside said housing in order to receive a permanent imprint of an identification of the firearm.

7. The firearm according to claim 1, wherein a seat is formed on a side of said housing for accommodating removable members having ornamental patterns.

8. The firearm according to claim 1, wherein said stock has an engagement element in a rear region for connecting a base-plate.

9. The firearm according to claim 8, wherein said stock is provided with a slot for fixing an optional strap or brace to the firearm, said slot being formed monolithically with the stock.

10. A portable firearm comprising a monolithic housing and stock made of plastic material and provided with a metal insert having a boxlike body; said insert having a front plate provided with a threaded coupling for a magazine and with a radiused coupling for a barrel of the firearm.

11. The firearm according to claim 10, wherein said housing has a transverse first cross-section and said metal insert has a transverse second cross-section substantially in the form of an inverted U and matching said first cross-section.

12. The firearm according to claim 11, wherein said insert is provided with a longitudinal member which is disposed inside said insert in an upper region thereof for guiding a breech member.

13. The firearm according to claim 12, wherein said longitudinal member is perforated to provide a support for optional accessories mounted to said housing.

14. The firearm according to claim 10, wherein said insert includes a rear shoulder formed by two folded flaps embedded in said plastic material.

15. The firearm according to claim 10, wherein said insert has a lower portion which is arranged outside said housing in order to receive a permanent imprint of an identification of the firearm.

16. The firearm according to claim 10, wherein said stock has an engagement element in a rear region for connecting a base-plate.

17. An The firearm according to claim 16, wherein said stock is provided with a slot for fixing an optional strap or brace of the firearm, said slot being formed monolithically with the stock.

18. The firearm according to claim 10, wherein a scat is formed on a side of said housing for accommodating removable members having ornamental patterns.

* * * * *